US005087038A

United States Patent [19]

Hao et al.

[11] Patent Number: 5,087,038

[45] Date of Patent: Feb. 11, 1992

[54] EXERCISING APPARATUS FOR ARMS

[76] Inventors: Kuo-Hua Hao, No. 19, Anshun Pei Erh St., Tiachung; Jui-Fang Hwang, No. Shanghsin 27, Shanghsin Li, Tsolan Chen, Miaoli Hsien, both of Taiwan

[21] Appl. No.: 667,492

[22] Filed: Mar. 7, 1991

[51] Int. Cl.[5] ..... A63B 21/00

[52] U.S. Cl. ..... 272/135; 272/67; 272/901; 272/136

[58] Field of Search ..... 272/135, 134, 136, 901, 272/DIG. 1, DIG. 5, 116, 901, 142, 130

[56] References Cited

U.S. PATENT DOCUMENTS

| | | | |
|---|---|---|---|
| 2,782,033 | 1/1956 | Ugartechea | 272/136 |
| 3,563,542 | 2/1971 | Wellman | 272/135 |
| 3,662,602 | 5/1972 | Weis | 272/DIG. 5 |
| 3,982,757 | 9/1976 | McDonnell | 272/134 |
| 4,575,076 | 3/1986 | Reichert | 272/136 |
| 4,603,857 | 8/1986 | Chipman | 272/136 |
| 4,754,964 | 7/1988 | Michaels | 272/135 |

FOREIGN PATENT DOCUMENTS

| | | | |
|---|---|---|---|
| 8402659 | 7/1984 | Sweden | 272/16 |

*Primary Examiner*—Stephen R. Crow
*Assistant Examiner*—J. Donnolly

[57] ABSTRACT

An exercising device includes a beam having a lower end pivotally supported on a base. A handle portion is provided to an upper portion of the beam. A spring is biased between the beam and the base. The user may hold the handle portion and may actuate the beam to rotate against the spring so that the user can practice training muscle groups of his arm.

6 Claims, 5 Drawing Sheets

EXERCISING APPARATUS FOR ARMS

BACKGROUND OF THE INVENTION

1. Field of the Invention

The present invention relates to an exercising apparatus for arms.

2. Description of the Prior Art

When a person's arm holds another person's arm and when the elbows of the two persons are rested on a table surface, the two persons may fight or contest with each other in order to know whose arm is stronger than the other. However, as far as the applicant is aware, there is no exercising apparatus commercially available at present for training the muscle groups of the arms for that particular purposes.

The present invention has arisen to provide an exercising apparatus for arms.

SUMMARY OF THE INVENTION

The primary objective of the present invention is to provide an exercising apparatus for training the muscle groups of the arms of a user.

In accordance with one aspect of the invention, there is provided an exercising device which includes a beam having a lower end pivotally supported on a base. A handle portion is provided to an upper portion of the beam. A spring is biased between the beam and the base. The user may hold the handle portion and may actuate the beam to rotate against the spring so that the user can practice training muscle groups of his arm.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
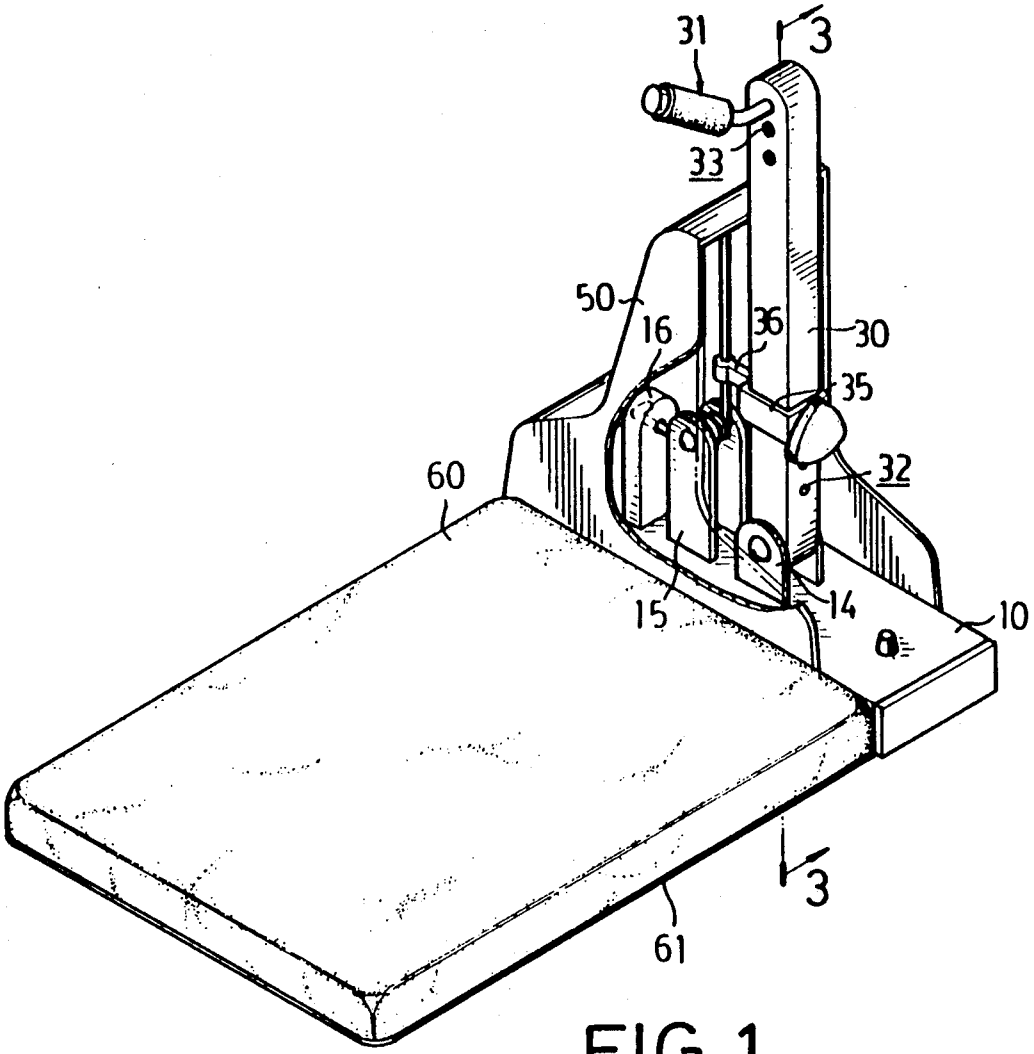
FIG. 1 is a perspective view of an exercising apparatus in accordance with the present invention, in which, for clearly illustration purposes, part of the casing is cutoff.
Figure 2:
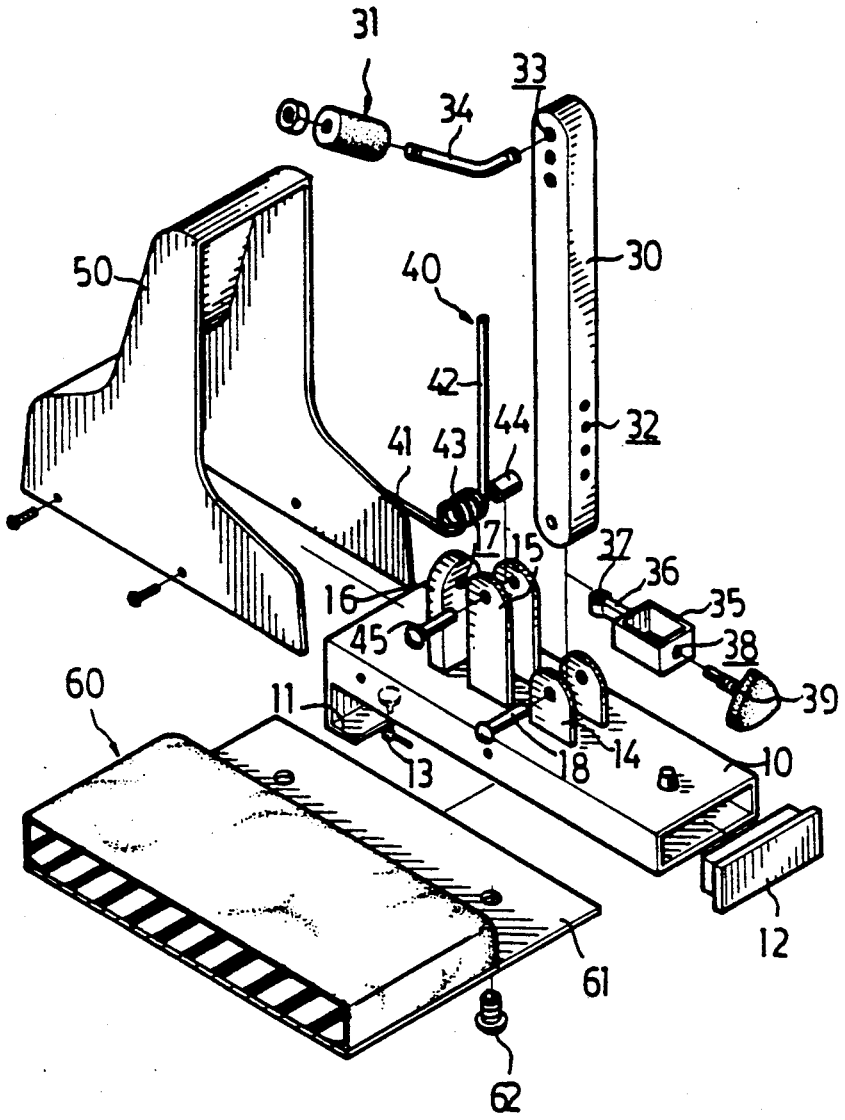
FIG. 2 is an exploded view of the exercising apparatus.

Referring to the drawings and initially to FIGS. 1 to 4, an exercising in accordance with the present invention comprises generally a beam 30 pivotally supported on a base 10 which is disposed on a table, and a spring 40 biased between the beam 30 and the base 10, a handle portion 31 is provided on the upper portion of the beam 30, the user may practice training his arms when his hand holds the handle portion 31 and when his elbow rests on the table.

Figure 3:
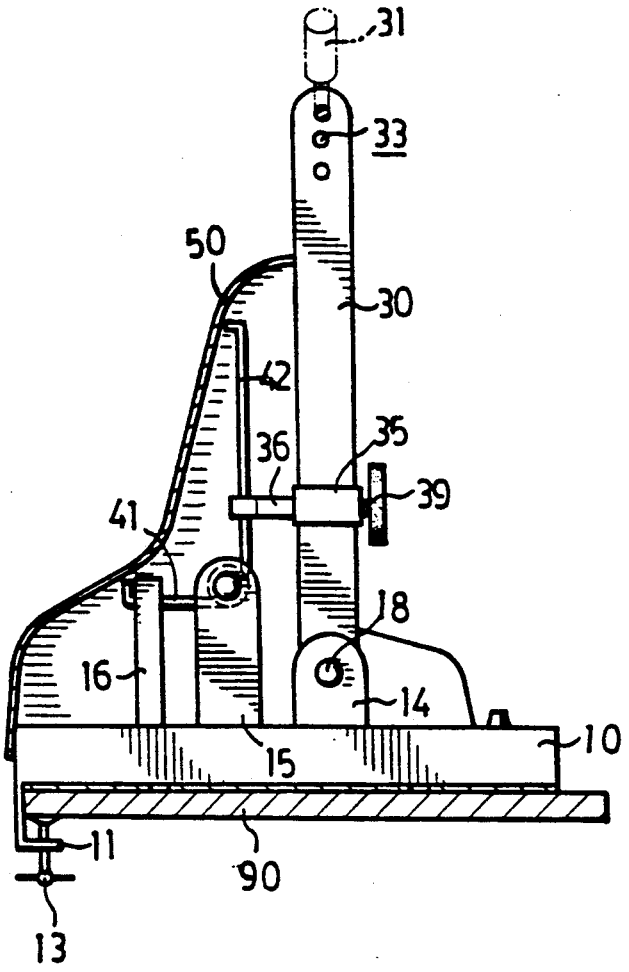
FIG. 3 is a cross sectional view taken along lines 3—3 of FIG. 1.
Figure 4:
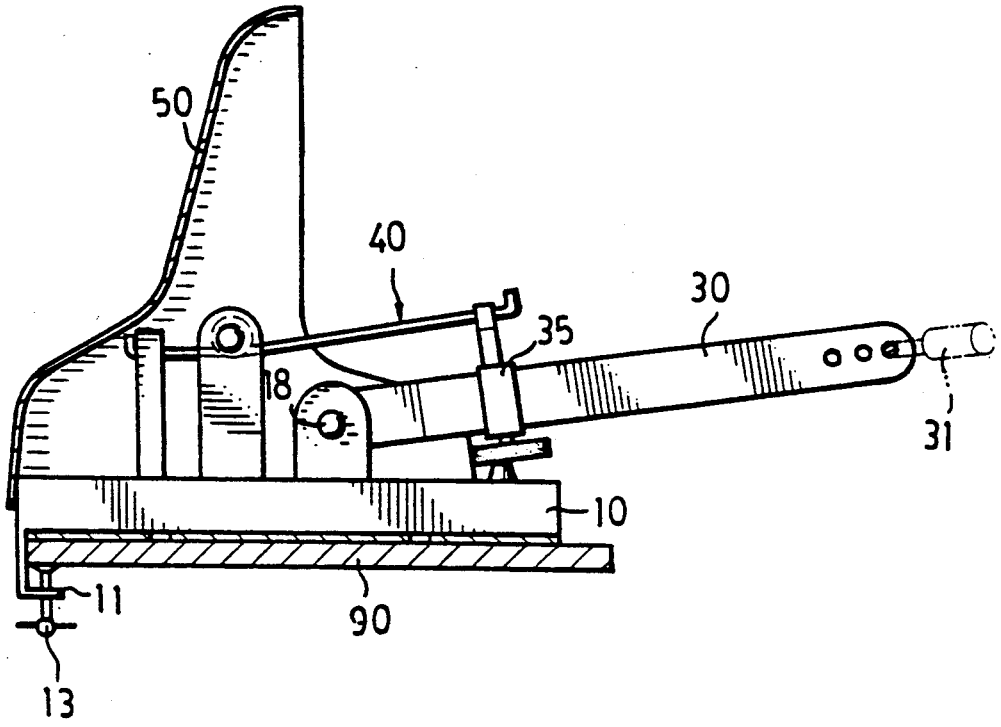
FIG. 4 is a cross sectional view similar to FIG. 3, illustrating an operation of the exercising apparatus.

The base 10 is rectangular parallelepiped having a flange 11 integrally formed on a bottom of a rear end thereof and having a front end enclosed by a cap 12. A clamping device 13 is disposed on the flange 11 so that the base 10 can be fixed to the edge of the table 90 (FIG. 3 and 4). Two pairs of lugs 14, 15 are integrally formed on the base 10, in which one pair has a height higher than the other. The lower end of the beam 30 is pivotally supported on the shorter pair of lugs 14 by a pin 18. A post 16 is integrally formed on the base 10 and faces toward the higher lugs 15. A hole 17 is formed in the upper portion of the post 16.

A plurality of holes 32 are formed in the lower portion of the front surface of the beam 30 and a plurality of screw holes 33 are formed in the upper portion of each side surface of the beam 30. The handle portion 31 is coupled to a rod 34 which has one end threaded to either one of the screw holes 33 so that the distance between the handle portion 31 and the pin 18 can be adjusted. The distance can be adjusted according to the length of the user's arm. A loop 35 is engagable on the beam 30 and has an extension 36 extends rearward therefrom. A hole 37 is formed in the free end of the extension 36. A screw hole 38 is formed in the front portion of the loop 35 for threadedly engaging a bolt 39. The free end of the bolt 39 can be engaged with either of the holes 32 so that the loop 35 can be fixed to the beam 30 and so that the distance between the loop 35 and the pin 18 can be adjusted.

The spring 40 includes two legs 41, 42 coupled together by a coiled middle portion 43. A sleeve 44 is engaged in the coiled portion 43 of the spring 40 and is rotatably supported on a pin 45 which is supported between the higher lugs 15. The leg 41 of the spring 40 extends through the hole 17 of the post 16 and a small segment of the free end of the leg 41 is preferably bent so that the leg 41 will not be disengaged from the hoe 17. The other leg 42 extends through the hole 37 of the extension 36 so that the spring 40 is biased relatively between the base 10 and the beam 30. When a user has a stronger arm, the loop 35 can be moved closer to the pin 18 so that, from the principle of lever, the resilience of the spring 40 exerted to the beam 30 is increased. On the contrary, when the loop 35 is moved away from the pin 18, the resilience to the beam 30 is decreased.

The casing 50 is fixed to the base 10 for covering the spring 40 so that the user will not be hurt by the spring 40. The sponge member 60 is fixed on a plate 61 which is fixed to the bottom of the base 10 by screws 62. The elbow of the user may rest directly on the table 90. However, the user may feel more comfortable when his elbow rests on the sponge member 60. When the hand of the user holds the handle portion 31 and when the elbow of the user rests on the sponge member 60, the beam 30 can be actuated to rotate against the resilience of the spring 40 (FIGS . 3 and 4) by the user so that the user can practice training the muscle groups of his arm. It is to be noted that the configuration of the exercising apparatus as shown in FIG. 1 is suitable for training the muscle groups of the left hands of the users.

Figure 5:
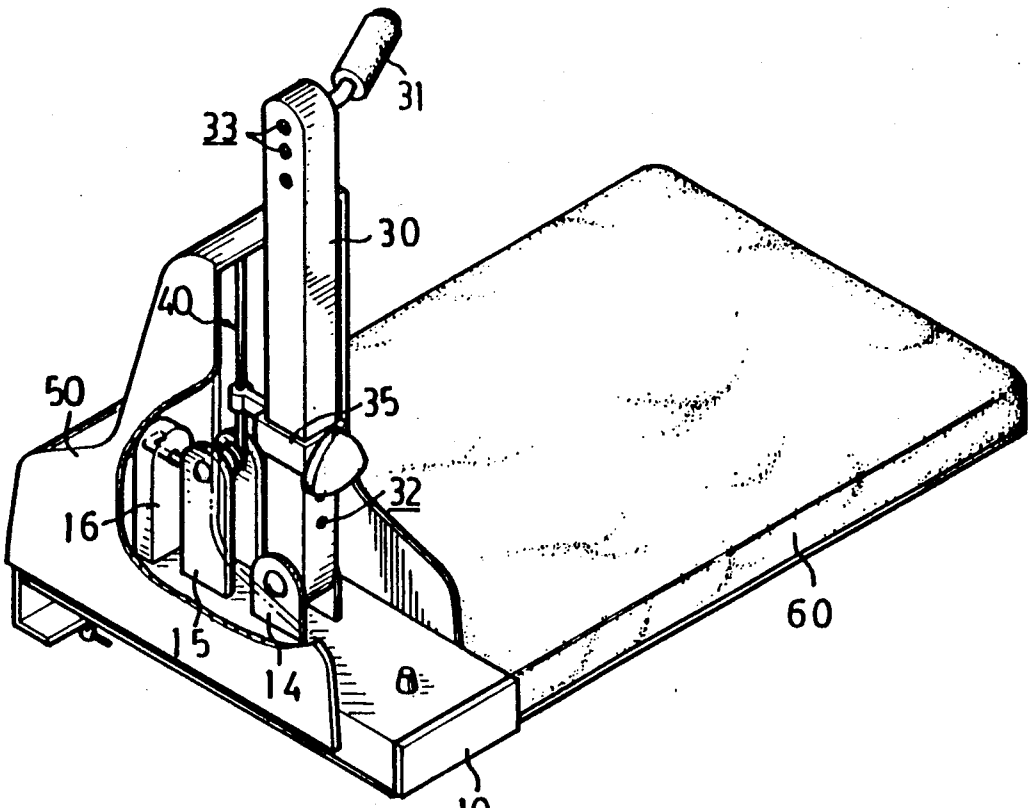
FIG. 5 is a perspective view similar to FIG. 1, illustrating that the positions of the sponge member can be changed.

Referring next to FIG. 5, when the sponge member 60 is fixed to the other side of the base 10 and when the handle portion 31 is fixed to the screw holes formed on the other side of the beam 30, a different configuration is formed as shown in FIG. 5. The configuration is suitable for training the muscle groups of the right hands of the users.

Accordingly, the exercising apparatus in accordance with the present invention can be used to practice the muscle groups of the user's arms.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising apparatus comprising a base, a post and a first pair of lugs and a second pair of lugs integrally formed on said base, a first hole formed in said post, a beam having a lower end pivotally supported on said base, a handle portion being provided to an upper portion of said beam, a lower end of said beam being pivotally coupled to said first pair of lugs by a pivot axle, a loop engaged on said beam and an extension integrally formed thereon, a second hole being formed in a free end of said extension, and a spring biased between said beam and said base, said spring having two legs coupled together by a middle portion which is supported on said second pair of lungs, a first leg of said spring extending through said first hole of said post and a second leg of said spring extending through said second hole of said extension so that said spring can be biased between said beam and said extension of said loop, whereby a user may hold said handle portion and actuate said beam to rotate said spring so that said user can practice training muscle groups of his arm.

2. An exercising apparatus according to claim 1, wherein a plurality of third holes are formed on a lower portion of one surface of said beam, a bolt is threadedly engaged to said loop and is engagable with either of said third holes so that a distance between said loop and said pivot axle can be adjusted and so that a resilience of said spring exerted to said beam can be adjusted.

3. An exercising apparatusf according to claim 1, wherein a plurality of screw holes are formed in an upper portion of each side surface of said beam, said handle portion is threadedly engaged to either of said screw holes by a rod so that a distance between said handle portion and said pivot axles can be adjusted.

4. An exercising apparatus according to claim 1, wherein flange is integrally formed on a bottom of one end of said base, a clamping device is disposed on said flange so that said base can be fixed to a table.

5. An exercising apparatus according to claim 1, wherein a sponge member is fixed on a plate which has one end fixed to a bottom of said base, said user's elbow may rest on said sponge member during exercising operations so that said user may feel more comfortable.

6. An exercising apparatus according to claim 1, wherein a casing is fixed to said base for covering said spring so that said user will not be hurt by said spring.

* * * * *

UNITED STATES PATENT AND TRADEMARK OFFICE

CERTIFICATE OF CORRECTION

PATENT NO. : 5,087,038

DATED : February 11, 1992

INVENTOR(S) : Kuo-Hua HAO et al.

It is certified that error appears in the above-identified patent and that said Letters Patent is hereby corrected as shown below:

On the title page, before item [57] ABSTRACT and
Under "Assistant Examiner" insert --Attorney, Agent or Firm—Fitch, Even, Tabin & Flannery--.

Column 1, line 55, after "exercising" insert --apparatus--.
Column 1, line 67, change "(FIG." to --(FIGS.--.
Column 2, line 16, change "extends" to --extending--.
Column 2, line 31, change "hoe" to --hole--.

Column 3, line 19, change "lungs" to --lugs--.
Column 3, line 25, after "rotate" insert --against--.
Column 4, line 8, change "apparatusf" to --apparatus--.
Column 4, line 13, change "axles" to --axle--.

Signed and Sealed this

Sixth Day of July, 1993

*Attest:*

Michael K. Kirk

MICHAEL K. KIRK

*Attesting Officer*

*Acting Commissioner of Patents and Trademarks*